United States Patent [19]

Simeth

[11] Patent Number: 4,596,468

[45] Date of Patent: Jun. 24, 1986

[54] SYSTEM FOR SCANNING COLOR PRINTING REGISTER MARKS PRINTED ON THE PRINTED SHEETS

[75] Inventor: Claus Simeth, Offenbach am Main, Fed. Rep. of Germany

[73] Assignee: M.A.N.-Roland Druckmaschinen Aktiengesellschaft, Fed. Rep. of Germany

[21] Appl. No.: 461,932

[22] Filed: Jan. 28, 1983

Related U.S. Application Data

[63] Continuation-in-part of Ser. No. 410,565, Aug. 23, 1982, abandoned.

[30] Foreign Application Priority Data

Sep. 16, 1981 [DE] Fed. Rep. of Germany ..... 3136701

[51] Int. Cl.[4] ..... B41F 13/24

[52] U.S. Cl. ..... 356/400; 101/DIG. 25; 356/73; 356/444

[58] Field of Search ..... 356/399, 400, 401, 444, 356/73; 101/DIG. 25

[56] References Cited

U.S. PATENT DOCUMENTS

| | | | |
|---|---|---|---|
| 2,802,666 | 8/1957 | Crosfield | 101/248 |
| 3,084,621 | 4/1963 | Guastavino | 101/181 |
| 3,339,817 | 9/1967 | French | 226/100 |
| 3,554,123 | 1/1971 | Lewallen | 101/170 |
| 3,567,923 | 3/1971 | Hutchison | 101/426 |
| 3,701,464 | 10/1972 | Crum | 101/248 |
| 3,915,090 | 10/1975 | Horst et al. | 101/426 |
| 3,958,509 | 5/1976 | Murray | 101/426 |
| 3,974,374 | 8/1976 | Inoue | 356/400 |
| 3,989,385 | 11/1976 | Dill et al. | 356/400 |
| 3,995,958 | 12/1976 | Pfahl et al. | 350/163 |
| 4,025,025 | 5/1977 | Bartel et al. | 226/33 |
| 4,116,125 | 9/1978 | Forster et al. | 101/212 |
| 4,135,664 | 1/1979 | Resh | 235/475 |
| 4,200,932 | 4/1980 | Schramm et al. | 364/519 |
| 4,233,663 | 11/1980 | Sugawara et al. | 101/170 |
| 4,318,176 | 3/1982 | Stratton et al. | 101/248 |

FOREIGN PATENT DOCUMENTS

| | | |
|---|---|---|
| 2023467 | 11/1971 | Fed. Rep. of Germany . |
| 297052 | 3/1972 | Fed. Rep. of Germany . |
| 56-28864 | 3/1981 | Japan . |

OTHER PUBLICATIONS

Heidelberg Offset CPC Brochure Published at Dupra, Jun. 3–16, 1977.

Der Polygraph (MAVO Article), 10/22/75, pp. 1393–1400 (translation included).

*Primary Examiner*—R. A. Rosenberger

*Attorney, Agent, or Firm*—Leydig, Voit & Mayer, Ltd.

[57] ABSTRACT

An apparatus and method for automatically checking and correcting register adjustment of a multi-color sheet-fed printing press wherein register marks are read by an ink densitometer on a remote control desk. The densitometer head is mounted on an X,Y positioning mechanism under the control of a register control computer so that the densitometer head scans cross-shaped register marks to determine both axial and peripheral register error. Preferably both right-hand and left-hand marks are used in order to pecisely determine skew or diagonal error, and the densitometer head rapidly traverses from one mark to the other mark. Preferably each register mark is made up of offset component marks of the primary colors and the positions of the marks are matched with their respective colors by the time sequence of scan path points of intersection. One color is chosen as a reference from which desired positions are calculated for the other component marks. The deviations are displayed to the operator and used as control values.

6 Claims, 12 Drawing Figures

SYSTEM FOR SCANNING COLOR PRINTING REGISTER MARKS PRINTED ON THE PRINTED SHEETS

This is a continuation-in-part of application Ser. No. 410,565, filed Aug. 23, 1982, now abandoned.

This invention relates to a method and apparatus for the production of high-quality multi-color printed sheets. At present the major printing machine manufacturers make and sell sheet-fed printing presses having remote controlled ink fountain keys for adjusting the density of ink applied to the sheets and remote controlled means for adjusting plate cylinder register so that the various colors on a multi-color sheet may be printed in exact register, one on top of the other.

To monitor the uniformity of the ink density, each sheet is printed with an ink density check strip which is scanned by an optical scanner. In practice, the scanning is usually performed at a control desk remote from the printing press. The control desk has a sheet support for receiving a test sheet and a traversing head having an optical sensor which scans across the check strip on the test sheet. The control desk may also have indicators and remote controls for adjusting the ink keys. Such a system is described, for example, in Schramm et al. U.S. Pat. No. 4,200,932 issued Apr. 29, 1980.

It is also known that the register of the plate cylinders in a multi-color printing press may be checked by printing register or alignment marks on the printed sheets. This is done, for example, by applying a mark of one color having a gap or tolerance range and printing a mark of another color within the gap or tolerance range of the first mark. This method is further disclosed in West German Patentschrift AT-PS No. 297052.

It is also known that the axial or side, peripheral or circumferential, and diagonal or skew register of a printing press may be controlled remotely from the press. But requiring the press operator to evaluate register marks and then to operate remote controls introduces the possibility of error and may limit the accuracy with which the register may be controlled.

The need for quick and accurate register adjustments is especially important in offset printing. In offset printing the ink impression is continuously displaced because of the use of a dampening solution in the printing process, and the need to wash the rubber blanket at regular intervals. The register displacements may occur suddenly, as in the case of washing the rubber blanket, or they may occur gradually because of variations in temperature and the resulting change in ink viscosity.

A general aim of the invention is to provide automatic measurement and control of register accuracy in the multi-color printing process.

Another object of the invention is to provide a method of automatic measurement and control of register adjustment that uses the existing optical densitometer scanning head at the remote control desk of conventional printing press control systems. In other words, the object of the invention is to provide a system whereby register marks printed on a printed sheet can be scanned outside the printing machine, deviations can be measured by a comparison of the actual and required values, and the peripheral and side register adjustment systems in the printing press can be adjusted so as to give an optimum color print.

In accordance with the present invention, a test sheet having register marks printed thereon is scanned at the remote control desk of a printing press control system of the type wherein the optical densitometer may be driven in two orthogonal directions with respect to the test sheet. In other words, the optical scanner may be driven to a desired programmed pair of x,y coordinates on the test sheet. Stops or other means are provided on the control desk to define the general position of the sheet with respect to the optical scanning system. Thus, under computer control the optical scanner is driven to the predetermined positions of the alignment marks. The alignment marks are scanned and any deviation of the register marks from their required positions is detected and control signals are generated responsive to the deviations. The values of the control signals are displayed to the operator or the control signals are fed to a register adjustment system. In other words, the relative positioning of the individual plate cylinders is adjusted either manually by the operator from the displayed control values, or automatically from the control signals depending upon the construction of the particular register adjustment system used with the printing press.

Preferably the register marks are in the form of crosses. So that the sheet need not be precisely positioned with respect to the control desk and optical scanning system, the different register marks corresponding to the different colors are printed one on top of the other but slightly offset by predetermined amounts. Then the register control computer in the system can differentiate among the register marks corresponding to the different colors by correllating the scanning data with the predetermined pattern according to which the register marks are printed, and any additional offset or deviation of each register mark from its predefined position is used to determine control values or a control signal.

A particularly advantageous embodiment scans the register marks in the form of crosses over a circular or surrounding path about their generally predetermined positions. With a scanning system of this kind it is possible to check both the peripheral and side register from the register marks during a single measuring operation or 360° scan on a circular or surrounding path about the center of the register marks. Diagonal or skew control values or control signals may also be generated by the system. Hence, automatic register adjustment can be provided at reasonable cost as an option or additional feature of a control desk for ink density measurement and remote control of the printing press.

Other objects and advantages of the invention will become apparent upon reading the following detailed description and upon reference to the drawings in which.

Figure 1:
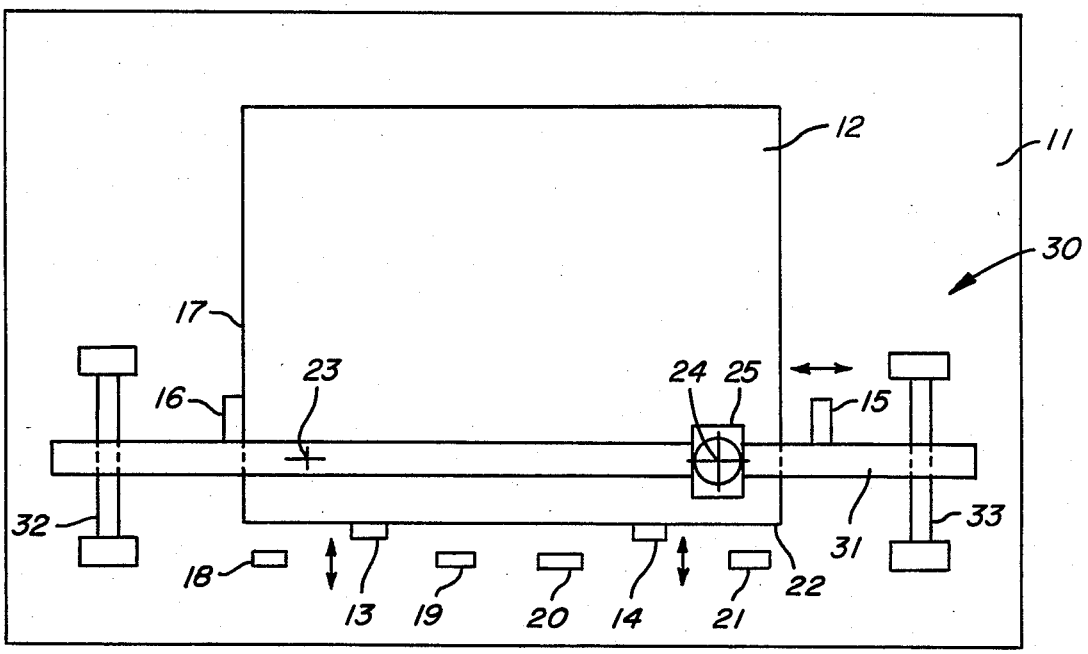
FIG. 1 is an elevation view of the sheet support on a control desk including an optical densitometer mounted to X,Y positioning means.

While the invention is susceptible to various modifications and alternative forms, a specific embodiment thereof has been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention as defined by the appended claims.

Turning now to the drawings, there is shown in FIG. 1 a sheet support 11 on a control desk or checking table which receives a test sheet 12. The sheet support 11 has adjustable contact stops 13, 14, and 15 against which the sheet 12 abuts to orient the sheet 12 in a predefined way with respect to the sheet support 11. In practice the adjustable stops 13, 14, 15 are aligned analgously to the alignment of the lays or stops in the entry or feed to the printing machine. Moreover, the edge 17 of the sheet 12 is fed against a stop 16 analogous to the manner in which the slide lay is used in the entry or feed of the printing machine to establish a zero axial register position for the fed sheets. A plurality of stops 18, 19, 20, 21 may also be provided for the front edge of the sheet 12 to enable minimum-format sheets to be placed exactly in position.

In order for a printing machine to be initially set up, left and right register marks 23, 24, respectively, are printed on the test sheet 12. These register marks have a fixed location on the printing plates in the printing machine. It is desirable for the printed matter including the register marks to be precisely printed at a predefined and repeatable location with respect to the sheets 12, and in particular for multi-color printing the different colors must be printed precisely in register. In a printing machine the register is adjustable by providing means for movement of the printing plates with respect to the machine frame, it being understood that the position of the sheets are defined with respect to the machine frame by the stops in the feed or entryway in the printing machine.

At present the major printing machine manufacturers make and sell remote control systems whereby register adjustment means in the printing machine are adjusted from a remote control station or desk. The remote control desk is typically provided with the sheet support 11 upon which the test sheet 12 is placed. In these systems, the press operator or printer observes the register marks 23, 24 using a reticulated magnifying glass to determine if the register marks 23, 24 are at their desired positions on the test sheet 12. The deviations or offsets of the register marks 23, 24 from their desired positions is manually read from the reticle on the magnifying glass and the offsets are then manually entered into register control input devices at the remote control station. It should also be noted that at most of these remote control stations an optical densitometer 25 is provided with means for moving the optical densitometer across an ink density check strip (not shown). In some of these systems the scanning of the ink density check strip by the optical densitometer 25 is performed under computer control, and data from the optical densitometer 25 is automatically processed to remotely and automatically adjust ink metering devices in the printing machine.

According to the invention, an optical scanner or sensor such as the optical densitometer head 25 is mounted to the sheet support 11 by means of an X,Y positioning mechanism generally designated 30. The X,Y positioning mechanism is under computer control and may be commanded to a range of desired coordinates x,y on the test sheet 12 corresponding to the general locations of the register marks 23, 24. It should be noted that the actual hardware for the X,Y positioning mechanism 30 as well as computer software for driving the positioning mechanism to desired coordinates is well known in the computer art. The combination of a sheet support 11 and an X,Y positioning mechanism is known as a flat bed plotter.

In carrying out the present invention, the desired coordinates of the register marks 23, 24 are predetermined and are known by the computer controlling the X,Y positioning mechanism. These desired positions are, in other words, reference values. The optical densitometer 25 is driven to the general location of the reference or desired coordinates of each register mark 23, 24 and is then driven along a path to scan or read the actual position of the register mark 23, 24. When the signal from the optical densitometer 25 indicates that the densitometer is precisely aligned over the register mark, at least one of the actual coordinates of the optical densitometer 25, which is known to the computer in such flat bed plotting systems, is stored. Register errors are calculated as the differences between the actual coordinates or positions of the register marks and their desired or reference positions. The register errors are displayed to the printing machine operator or are automatically fed to the automatic register adjustment means in the printing machine.

In the embodiment shown in FIG. 1, the optical densitometer head 25 is secured to a guide rail 31 disposed at a predetermined distance above the sheet support 11. Under computer control, the densitometer head 25 traverses along the rail 31 in the X direction. The rail 31 is itself slidably mounted on longitudinal rails 32, 33 and is driven in the Y direction under computer control. From a "home" or reference position, for example the lower left-hand corner of the sheet 12, the densitometer head 25 is driven to the vicinity of one of the reference marks, for example the left-hand reference mark 23. The reference mark 23, in the form of a cross, is scanned by the optical densitometer head 25 moving in, for example, a circular path surrounding the center of the cross. The axial and peripheral errors or control values are determined from the actual positions of the respective longitudinal and transverse segments of the cross. The actual positions of the segments are indicated by the points of intersection of the circular path with the segments. The optical densitometer emits electrical pulses coincident with the points of intersection being scanned. Thus the points of intersection indicating the respective peripheral and axial register are offset by about 90 degrees on the circular path. If the circular path is precisely centered on the desired coordinates of the register mark 23, the points of intersection will be offset by 90 degrees if the axial and peripheral register is correctly adjusted.

Figure 2:
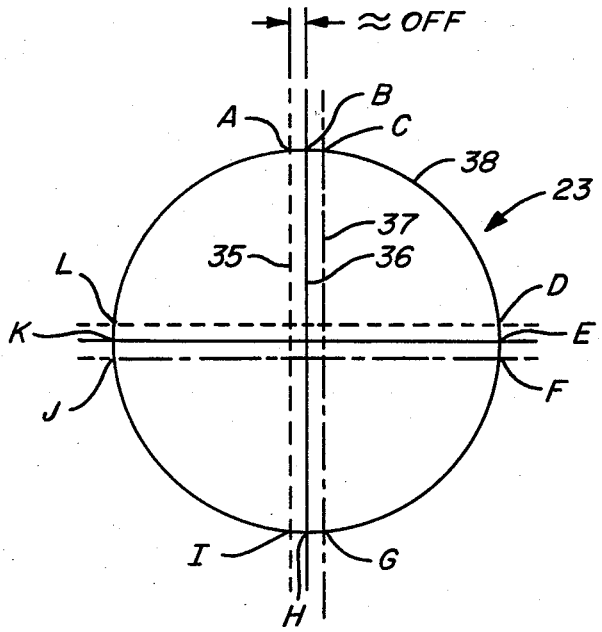
FIG. 2 is a detailed view of a register mark and an exemplary scanning path followed by the optical densitometer when scanning the register mark.

A detailed view of the reference mark 23 is shown in FIG. 2. For the purpose of registering three primary colors, respective individual component marks or crosses 35, 36, 37 of the different colors are printed on the test sheet and are offset from each other by a predetermined offset OFF. The optical densitometer head 25 is driven, for example clockwise, along a path 38 around the center of the alignment mark 23. Due to the offset OFF the points A, B, C . . . L are scanned in an unambiguous time sequence. The register control computer can correlate or match the detected mark coordinates as the coordinates of respective points of intersection A, B, C . . . L corresponding to the three primary colors. By subtracting the offset OFF from the differences in the measured coordinates, the relative registration of the crosses 35, 36 and 37 are determined with respect to each other, without regard to the actual position of the sheet 12 with respect to the sheet support 11. If the center cross 36, for example, is chosen as an absolute reference, the difference between the X coordinates of points C and B is subtracted from the offset OFF to indicate the relative axial register error of the register mark 37 printed by an adjusted printing plate. Similarly, the difference between the Y coordinates of points D and E is subtracted from the offset OFF to calculate the relative peripheral error in the printing register mark 37. Note, of course, that this presumes that the register errors will never exceed the predetermined offset OFF, which is reasonable since the initial set up of the printing plates can be performed with sufficient degree of precision.

Figure 3:
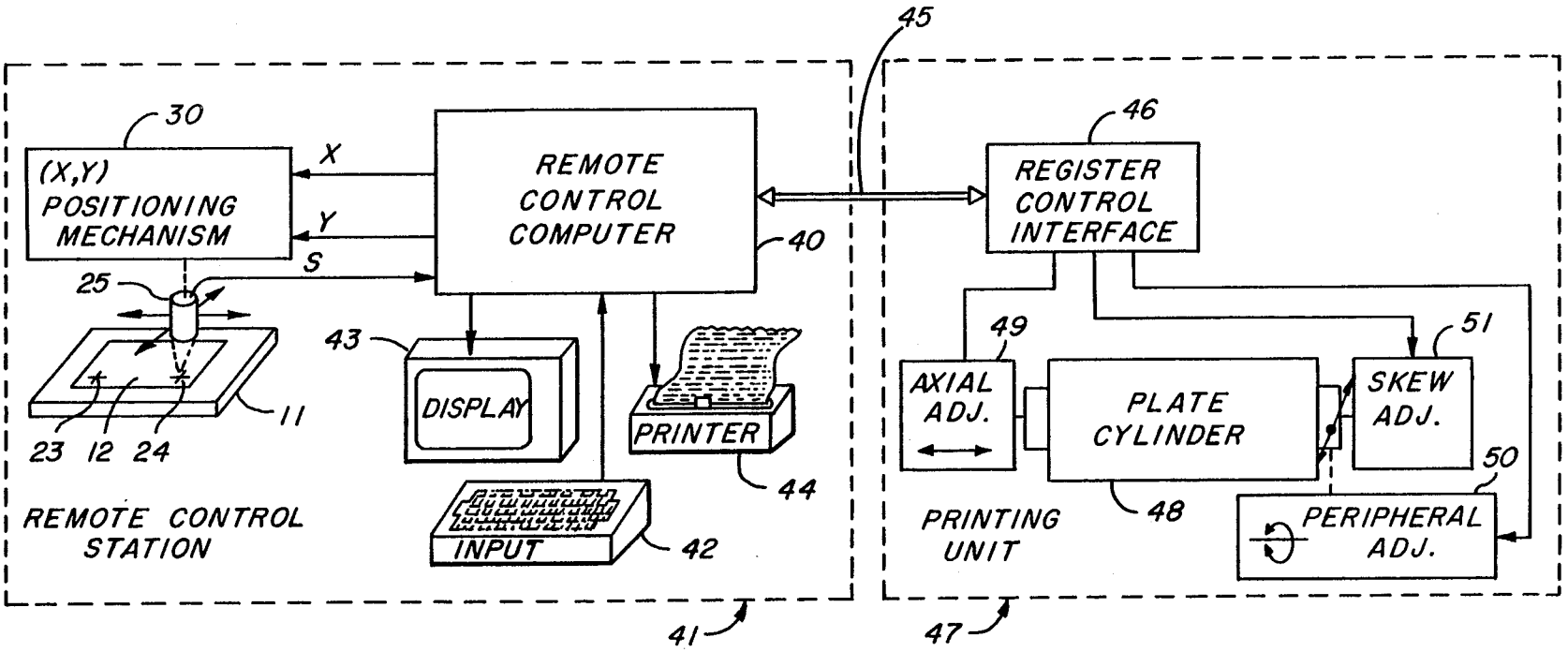
FIG. 3 is a schematic diagram showing the individual components and flow of information in an automatic register adjustment system according to the invention.

The axial and peripheral register errors are calculated and used for automatic register control in the overall system shown in FIG. 3. In addition to the sheet support 11 and optical scanner 25, the remote control system for the printing press also comprises a remote control computer 40 which is typically provided at the remote control station or control desk generally designated 41. The remote control computer 40 communicates with the printing machine operator via an input device such as a keyboard 42 and output devices such as a display 43 and a printer 44. The remote control station 41 is linked via a connection 45 to a register control interface 46 in the printing unit generally designated 47. The register control interface 46 may itself be a separate microcomputer, and as is known in the art a number of printing units 47 each having a respective register control interface 46 may be controlled by a single remote control station. The remote control interface 46 may also be the same microcomputer or control device operating ink keys or other ink metering devices. As explained above in general terms, the X coordinate deviations in the register marks 23, 24 give an indication of the required axial adjustment of at least one plate cylinder 48 in the printing unit. The adjustment is mechanically performed by an axial adjustment device 49 which translates the printing plate on the plate cylinder 48 in an axial direction with respect to the machine frame of the printing unit 47. Similarly, the deviations or offsets in the Y coordinates of the register marks 23, 24 is an indication of peripheral register error and the phase or relative drive angle of at least one plate cylinder 48 is adjusted to correct the peripheral register error. For this purpose, a peripheral or circumferential adjusting device 50, inserted in the press drive which rotates the plate cylinder 48, mechanically provides the peripheral register adjustment.

For complete register adjustment a skew or diagonal adjustment is required for at least one of the plate cylinders 48. The skew error is determined as the difference between the Y coordinates of register marks that are displaced from each other in the X direction. In other words, the skew or diagonal offset is related to a relative rotation of the register marks 23, 24 printed on the test sheet 12. Although this rotation could be determined from the two separate Y coordinate differences determined from a single reference mark, for example the differences of the Y coordinates of points L and K versus points D and E in FIG. 2, the diagonal or skew error is more precisely calculated from Y coordinate offsets for widely spaced register marks. For this purpose, the optical densitometer 25 first scans the left-hand reference mark 23 and then quickly traverses to the right-hand reference mark 24. The average Y coordinate offset for the right-hand reference mark 24 is then subtracted from the Y coordinate offset for the left-hand reference mark 23 in order to calculate the skew or diagonal offset. The calculations are performed by the remote control computer 40 and as with the axial and peripheral adjustment errors, the skew offset is passed along the link 45 to the register control interface 46 for use as a control variable. The skew control variable is sent to a skew adjusting device 51 in the printing unit 47. The skew adjusting device 51 mechanically performs the skew adjustment, for example, by radially shifting at least one end of the plate cylinder 48 axis.

Figure 4:
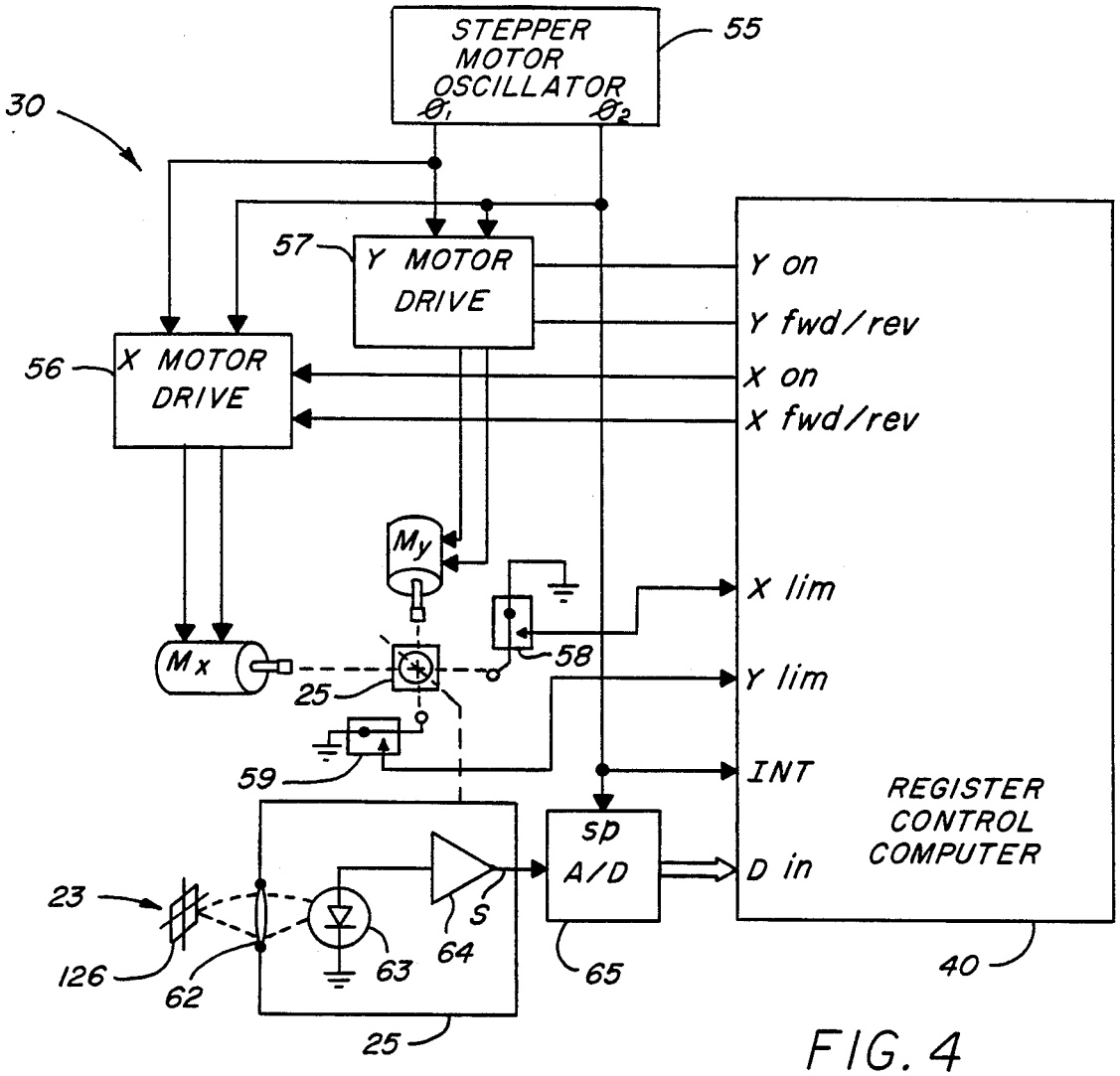
FIG. 4 is a schematic diagram of the interconnections among the X,Y positioning means, the optical densitometer, and the register control computer according to an exemplary embodiment of the invention.

An exemplary interface between the optical densitometer 25, the register control computer 40 and the X,Y positioning mechanism 30 is shown in FIG. 4. The embodiment there shown uses the register control computer 40 to keep track of the position or x,y coordinates of the densitometer head 25. The register control computer 40 could be the only microcomputer at the remote control station 41 and could perform other tasks such as link density control, or a separate microcomputer could be used to calculate the register errors and drive the X,Y positioning mechanism 30. As shown in FIG. 4, the X,Y positioning mechanism 30 has two stepper or synchronous motors Mx, My which drive the densitometer head 25 in the respective X and Y directions. The motors Mx and My step in synchronism with a stepper motor oscillator 55 having a plurality of phases such as $\phi_1$ and $\phi_2$. These plurality of phases are fed to the stepper motors Mx and My through motor drives 56, 57, respectively. The motors are turned on and off by signals Xon and Yon, respectively, and the directions of the motors are determined by signals Xfwd/rev and Yfwd/rev, respectively. One of the stepper motor oscillator phases $\phi_2$ is fed to the interrupt input INT of the register control computer 40 so that the register control computer 40 may count and control the individual steps of the motors. The X,Y positioning mechanism 30 also has X and Y limit switches 58, 59, respectively, for detecting the initial or "home" coordinates. These limit switches 58, 59 input signals Xlim and Ylim, respectively, to the register control computer 40.

The optical densitometer head 25 is shown having a lens 62 focusing a point of the image of the alignment mark 23 on a photo diode or detector 63. From the photo current, a preamplifier 64 generates an intensity signal S which is fed to an analog-to-digital converter (A/D) 65 which samples the intensity signal S coincident with the interrupt to the register control computer 40. The coincidence is obtained by feeding the oscillator phase $\phi_2$ to the sample pulse input SP of the analog-to-digital converter 65. Thus, during each interrupt a digital sample of the intensity S is received on the inputs Din of the register control computer 40. In summary, with the interface shown in FIG. 4, the position counting, motor stepping, and optical sensing is all performed periodically on a timed interrupt basis.

Figure 5:
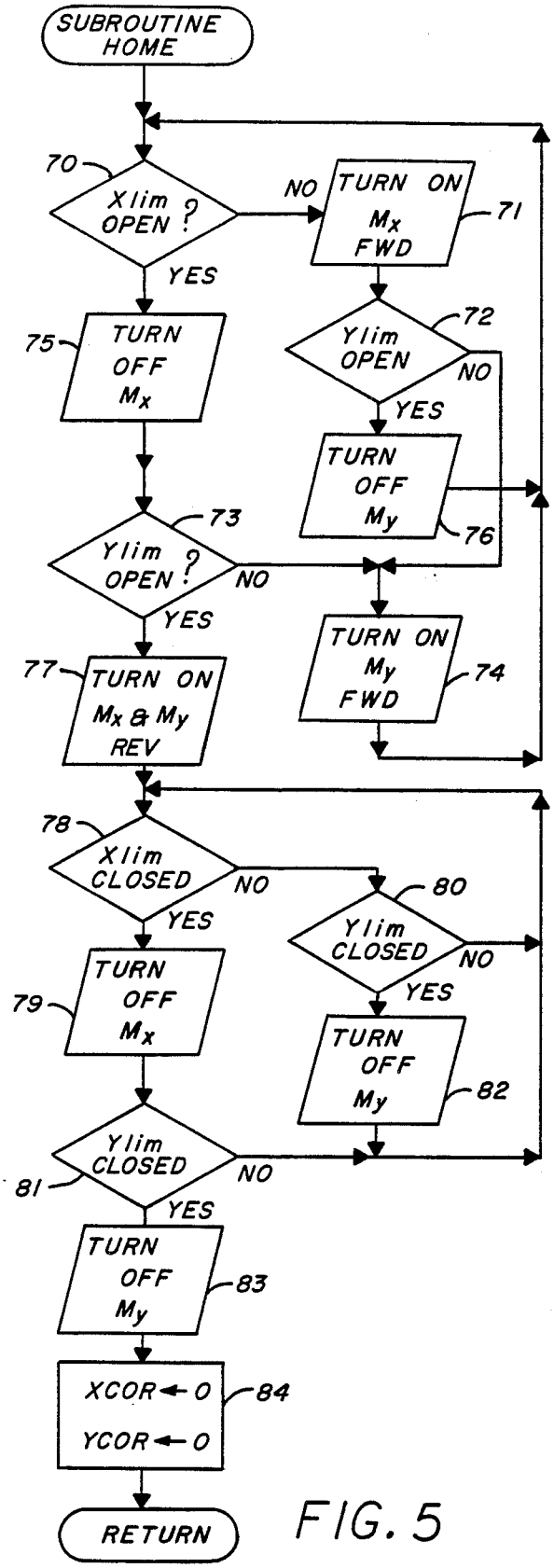
FIG. 5 is a flow chart of an exemplary procedure executed by the register control computer to command the X,Y positioning means to drive the optical densitometer head to a predefined "home" position.
Figure 6:
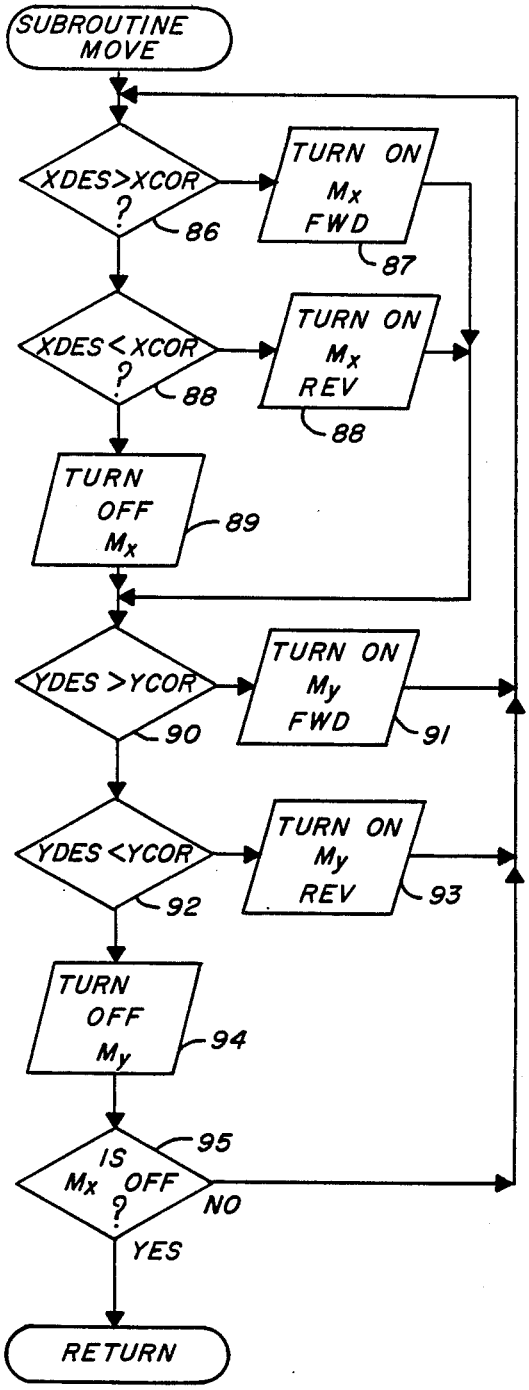
FIG. 6 is a flow chart of a procedure executed by the register control computer to command the X,Y positioning means to drive the optical densitometer head to a desired position on the sheet.

The most elementary operations performed by an X,Y positioning mechanism are shown in the flow charts of FIG. 5 and FIG. 6. Whenever the positioning mechanism is first used, it must be initialized so that its origin or reference coordinates correspond to a predefined physical location. In such a system, registers or memory locations XCOR and YCOR store the instantaneous values of the actual x,y coordinates. These values must be set to zero when the positioning mechanism reaches its physical origin. In the embodiment shown in FIG. 4, the physical origin is defined as those coordinates reached when the densitometer head 25 is driven into and closes the respective limit switches 58, 59.

In order to drive the densitometer head 25 to close the limit switches, it is first necessary to make sure that neither of the limit switches is not already closed, and if either is closed, the densitometer head must be driven to a position wherein both limit switches are open. For this purpose, in step 70 of the HOME subroutine of FIG. 5, the signal Xlim is tested and if it is a logical zero indicating that the X limit switch 58 is closed, the motor Mx is turned on to move forward in step 71. Similarly, in step 72 and in step 73 if the Y limit switch 78 is closed, the motor My is turned on to move forward as shown in step 74. The limit switches are then successively checked and if the X limit switch 58 later becomes open the motor Mx is turned off in step 75, and similarly if the Y limit switch 59 opens the motor My is turned off in step 76. When both limit switches open, both motors Mx and My are turned on reverse in step 77 to drive the densitometer head 25 into the open switches. When the X limit switch 58 closes as tested in step 78, the motor Mx is turned off in step 79. Similarly, when the Y limit switch closes as detected in step 80 and 81, the motor My is turned off in step 82 or 83, respectively. Hence, at step 84, both limit switches 58 and 59 are closed, both motors Mx and My are off, and thus the densitometer head 25 is at its home position. Therefore, the registers or memory locations XCOR and YCOR are set to zero in step 84, completing the HOME subroutine of FIG. 5.

The second basic function performed by the X,Y positioning mechanism 30 is to drive the densitometer head 25 to a desired pair of coordinates XDES, YDES. For this purpose in the MOVE subroutine of FIG. 6, the actual X coordinate XCOR is compared to the desired coordinate XDES and if the actual coordinate is smaller as tested in step 86 the motor Mx is turned on forward in step 87. If the actual coordinate XCOR is larger than the desired coordinate XDES as tested in step 88, the motor Mx is turned on reverse in step 88. If the actual and desired coordinates are equal, then the motor Mx is turned off in step 89. Similarly the desired Y coordinate YDES is compared to the actual Y coordinate YCOR and the motor My is turned on or off as shown in steps 90–94. If both the motors Mx and My have been turned off, then the desired and actual coordinates match and thus the required movement of the densitometer head 25 has been performed, as determined in step 95.

Figure 7:
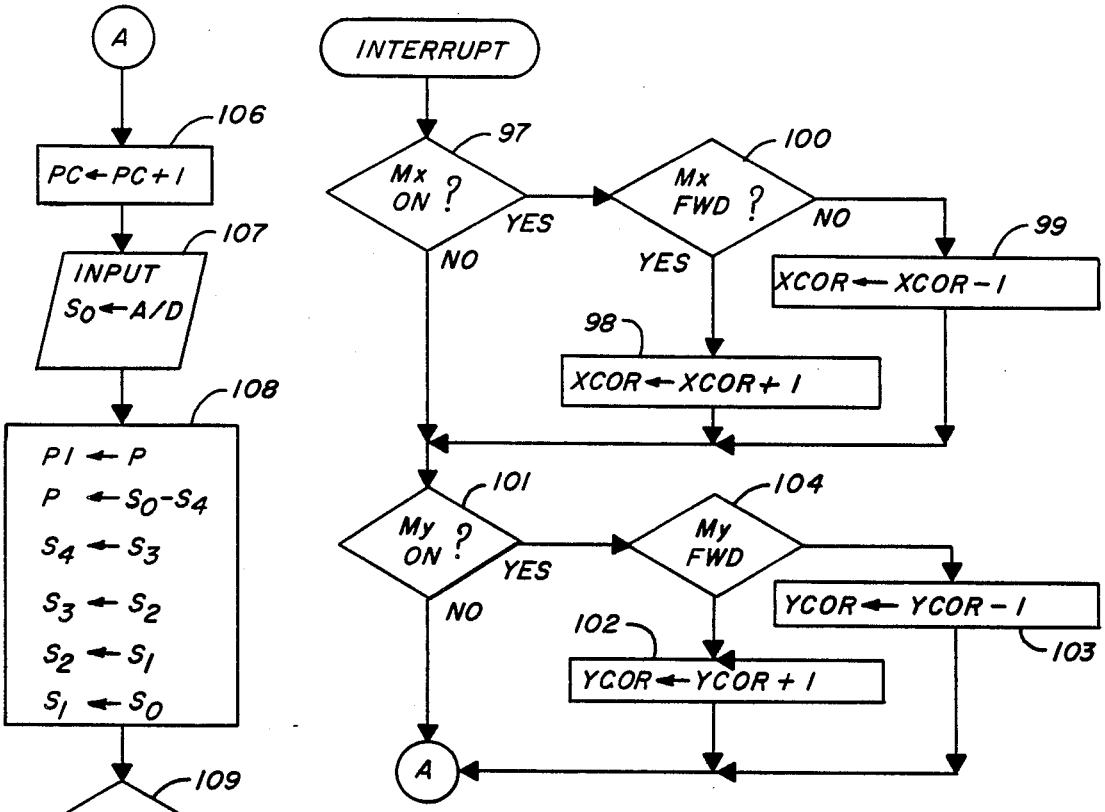
FIG. 7 is a flow chart of an interrupt procedure, executed by the register control computer, which keeps track of the instantaneous x,y coordinates of the optical densitometer head.

The MOVE subortine of FIG. 6 has assumed that the actual coordinates XCOR and YCOR are continuously updated as the densitometer head 25 moves. This continuous updating is performed on interrupt by the interrupt procedure shown in FIG. 7. During each interrupt cycle, if the stepper motor Mx is on as tested in step 97 then the actual X coordinate XCOR is incremented in step 98 or decremented in step 99 depending on whether the motor Mx is driven forward or reverse, respectively, as determined in step 100. Similarly, if the motor My is on as tested in step 101, the actual coordinate YCOR is incremented in step 102 or decremented in step 103 depending on whether the motor My is driven forward or reverse, respectively, as determined in step 104.

Figure 8:
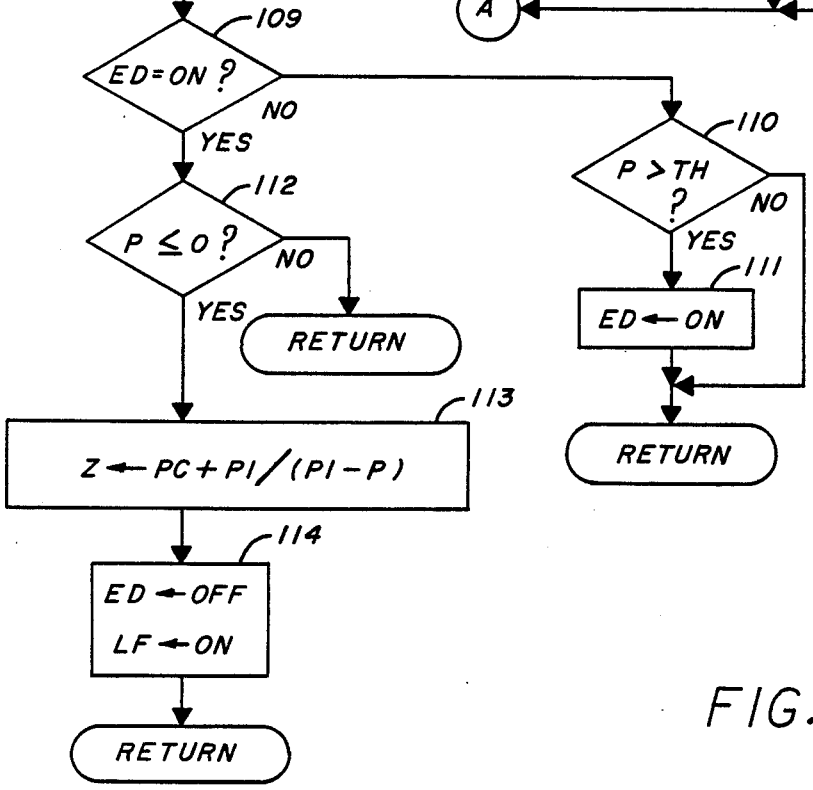
FIG. 8 is a flow chart of a continuation of the interrupt procedure of FIG. 7, the continuation including steps for detecting the register marks and precisely determining their coordinates on the sheet.

The interrupt procedure also determines whether the densitometer is focused upon a register mark 23, 24 as shown in FIG. 8. The presence of a register mark is detected by comparing the output of the densitometer to a predetermined threshold TH. If, for example, the densitometer signal is below the threshold, it is assumed that the densitometer is focused upon a blank portion of the test sheet. If, however, the densitometer signal exceeds the threshold, it is assumed that the densitometer is focused upon a portion of one of the register marks. This simple threshold detection scheme, however, responds to the ambient illumination level and also the width of the alignment mark. Preferably the detection process should be independent of the illumination level and should sense the midpoint of the register mark so as not to be influenced by variations in the line width of the register mark.

Figure 9:
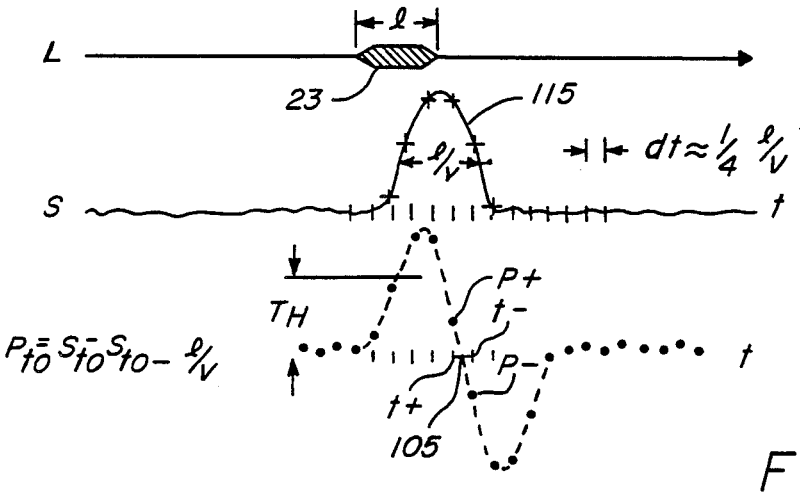
FIG. 9 illustrates the numerical procedure for detecting the precise position of a register mark, independent of the ambient illumination level and line width of the mark.

An exemplary detection procedure is illustrated in FIG. 9. The analog-to-digital converter 65 samples the light intensity signal S at a sufficiently high rate so that there are at least four samples along the line width 1 of the register mark as the register mark is scanned. In other words, the sampling period dt is at least as small as $\frac{1}{4}$ 1/v where v is the velocity at which the densitometer 25 scans across the test sheet 11. The register control computer 40 executes a digital filter procedure upon the samples on its input Din in order to select the position information inherent in the time series of samples. An exemplary digital filter is "tuned in" to the predominant spatial frequency of the alignment mark 23 by computing the difference between the current sample $S_{t0}$ and the previous sample $S_{t0-1/v}$ occurring four sample intervals previously, this time delay being the time for the densitometer 25 to traverse the width 1 of the alignment mark 23. The position of the alignment mark 23 then becomes the effective zero crossing 105 of the digital output $P_{t0}$. The zero crossing 105 may be determined by linear interpolation between the samples P+ and P− at times t+ and t− and having opposite polarities or sines.

A specific procedure for performing the above mentioned detection procedure is shown in FIG. 8. Upon each interrupt, a position counter PC is incremented in step 106. In step 107 the numeric value of the analog-to-digital converter 62 output on the input port Din of the register control computer 40 is read into a temporary storage location $S_0$. In step 108, digital filtering on the sample $S_0$ is performed by first storing the previous digital filter output P in a storage location $P_1$ and then calculating the new value of the digital filter output P as the difference between the current sample $S_0$ and the value $S_4$ denoting the fourth prior sample of S. The fourth prior sample $S_4$ is obtained from a first-in-first-out stack having temporary storage locations $S_4$, $S_3$, $S_2$, and $S_1$.

The actual position detection procedure starts with step 109 which test the edge detect flag ED to determine whether the register control computer should be looking for the leading edge of a register mark or whether it should be looking for the effective zero crossing 105 (FIG. 9). If the edge detect flag is on, then in step 110 the register control computer looks for the leading edge of the alignment mark by comparing the digital filter output P to a predetermined threshold TH. The threshold should be a function of the ambient illumination as suggested by FIG. 9, and it could be determined from the measured ink density values from the densitometer sensor 25, or from measured values of previous or initial register marks 23. If the digital filter value P is greater than the threshold TH, then the leading edge of a mark 23 has been detected and the edge detent flag ED is set on in step 111. Otherwise, the interrupt routine has completed its execution for the current sample $S_0$. If the edge detect flag is on in step 109, then in step 112 the register control computer must look for the zero crossing 105 by comparing the digital filter value P to zero. If the digital filter value P is greater than zero, then the interrupt routine has finished its processing for the current sample $S_0$. Otherwise, the current digital filter sample P is less than or equal to zero, corresponding to P− in FIG. 9, while the previously stored digital filter sample P1 corresponds to P+ in FIG. 9. Thus the relative position of the zero crossing 105 may be calculated in step 113 as the current value of the position counter PC plus a linear interpolation fraction of P1/(P1−P). It should be noted that by linear interpolation, the relative position is known to much greater precision than a single step of the stepper motors Mx, My. But only the relative position is known since there may be some error in the initial closing of the limit switches 58, 59. The absolute position, however, is irrelevant since only the differences between relative position are used in the calculation of the register errors. Finally, in step 114, the edge detect flag ED is set off, and the line flag LF is set on to tell the executive procedure and foreground routines executed by the register control computer that the position Z of a register mark has been calculated.

It should be noted that although the interrupt procedure of FIGS. 8 and 9 employs digital filtering, the signal from the optical densitometer 25 is itself filtered and band limited by the high frequency cut-off of the preamplifier 64. Preferably, this high frequency cut-off is selected so that the signal S has a rounded pulse 115 as shown in FIG. 9 when a register mark 23 is scanned. It is also possible to use optical filtering wherein an optical filter or mask in the shape of a cross, matching the shape of the register mark 23, is disposed in the optical path from the register mark 23 and the test sheet 12 to the photodiode or photodetector 63. Such a mask would permit the photodiode 63 to be responsive to a much larger image area and hence receive a larger signal, even though the change in signal represented by the steep slope of the pulse 115 in FIG. 9 would similarly be increased due to the sharp correlation between such an optical mask and the image of the register mark 23.

Figure 10:
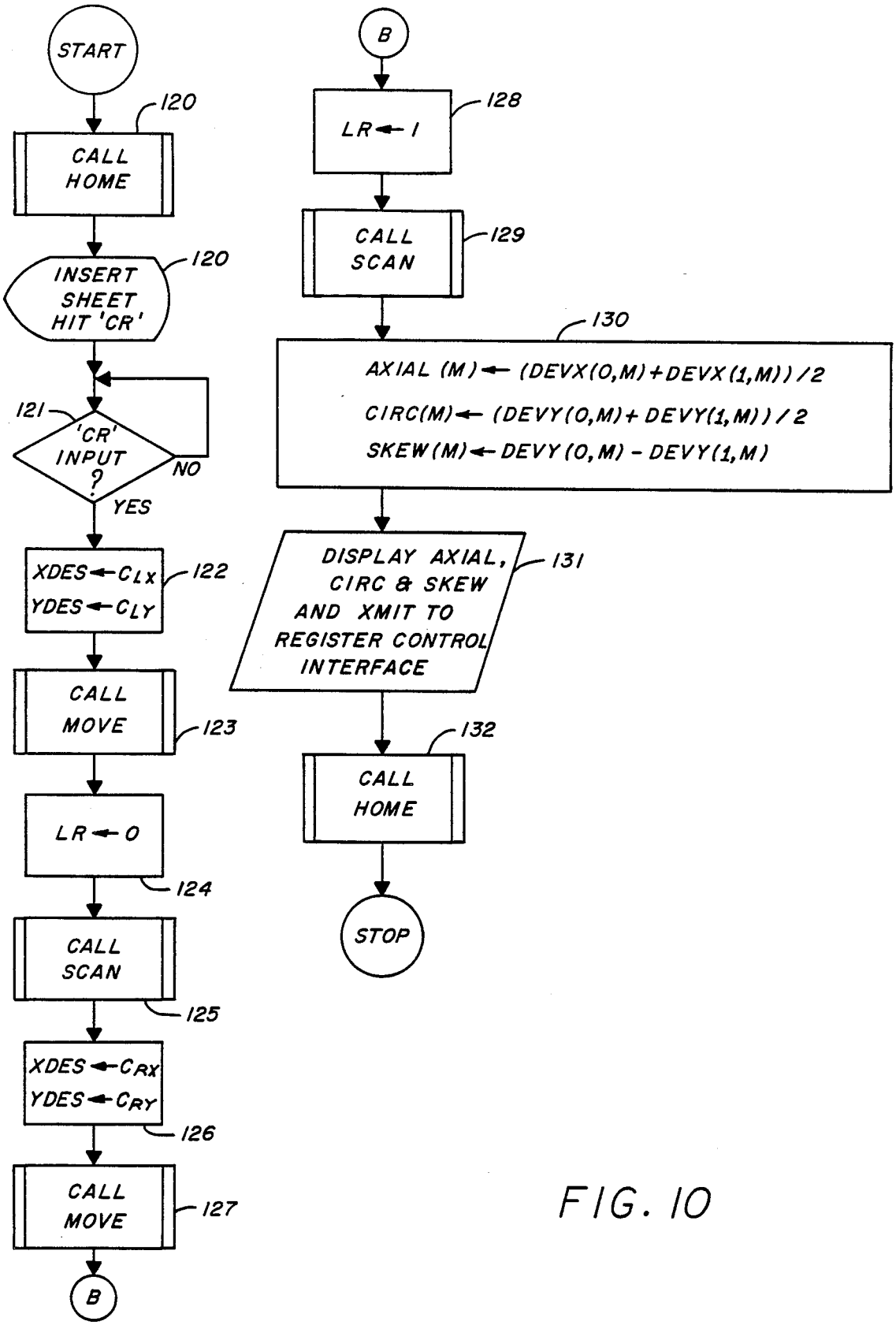
FIG. 10 is the executive procedure executed by the register control computer to scan the sheet, determine the register errors, and to transmit the register errors to the register control interface at the printing machine.

An exemplary executive program executed by the register control computer 40 is shown in FIG. 10. The executive procedure start whenever power to the register control computer 40 is turned on or whenever the printing machine operator activates a reset switch on the register control computer. The first step in the executive procedure is a call to the HOME subroutine in step 120. At this point the system is ready to receive a test sheet 12 on the sheet support 11. In step 121 a message is displayed to the printing machine operator to prompt him to insert a test sheet, and in step 121 the register control computer waits for the operator to acknowledge that a test sheet has been supplied. In step 122 the desired coordinates XDES, YDES are set to the predetermined coordinates $C_{1x}$ and $C_{1y}$, respectively, of the left-hand register mark 23. In order to drive the densitometer 25 to these desired coordinates, the subroutine MOVE is called in step 123. In step 124 the left-right flag LR is set to zero in order to tell the scan subroutine, which is called in step 125, that the left alignment mark 23 is being scanned. By calling the subroutine SCAN in step 125, the densitometer head scans the alignment mark 23 around a square path (126 in FIG. 4) in order to determine the points of intersection A-L in analogy with FIG. 2. This particular SCAN subroutine uses a square scanning path 126 instead of a circular path 38 for the sake of simplifying the computer program. The result of the SCAN subroutine is a set of X and Y offset or register errors for crosses 35 and 37 with respect to the center cross 36 which is chosen as a reference. (See FIG. 2). These offsets are stored in arrays DEVX and DEVY, respectively. In step 126 the desired coordinates XDES, YDES are set to the predetermined coordinates $C_{rx}$ and $C_{ry}$ of the right-hand register mark 24. The subroutine MOVE is called in step 127 to move the densitometer 25 to the location of the right-hand register mark. In step 128 the left-right flag LR is set to 1 and in step 129 the subroutine SCAN is called in order to scan the right-hand register mark.

After scanning both the left and right-hand register marks, the register errors or deviations of the crosses 35 and 37 with respect to the center cross 36 are packed into arrays DEVX, DEVY which are two dimensional, having a first index which is zero to designate the error for the left-hand register mark 23 or 1 to designate the error for the right-hand register mark 24, and having a second index M which is 1 to designate the deviation of the cross 35 from the center reference cross 36, or which is 2 to designate the deviation of the cross 37 from the reference cross 36. In step 130 the axial deviation AXIAL for the printing plates of the two primary colors corresponding to crosses 35 and 37 are calculated as the average of the X coordinate deviations DEVX for the left and right-hand register marks 23, 24, respectively. Similarly the peripheral or circumferential register error CIRC is calculated as the average of the Y coordinate deviations DEVY for the left and right-hand register marks. The skew or diagonal register error SKEW is calculated as the difference between the Y coordinate deviation DEVY for the left-hand versus the right-hand reference mark. In step 131 the register errors AXIAL, CIRC, and SKEW are displayed to the printing machine operator and are also automatically transmitted to the register control interface 46 so that the register adjustments are automatically performed. At the completion of the executive program of FIG. 10, the densitometer 25 is driven to its home position in step 132.

Figure 11:
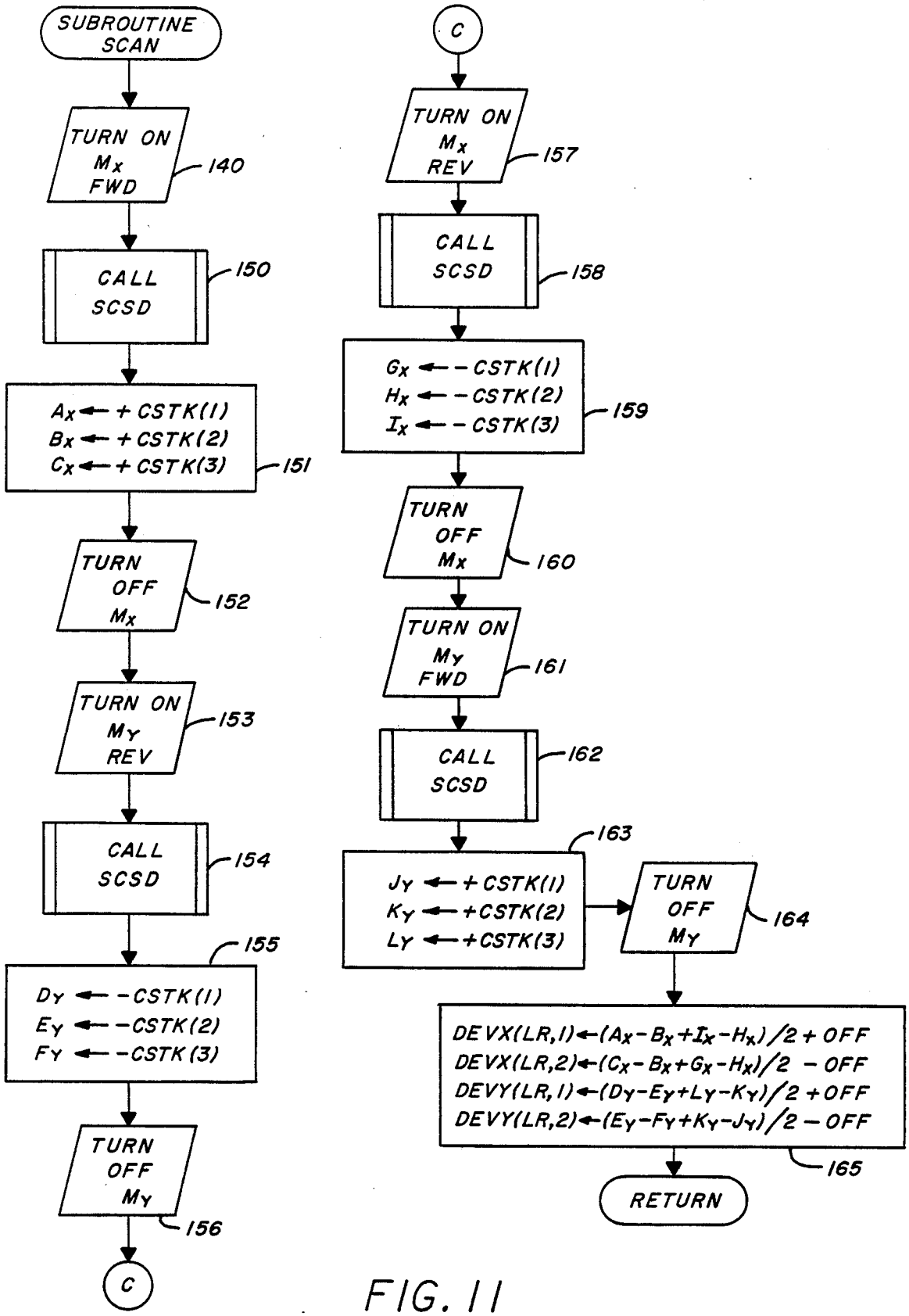
FIG. 11 is a flow chart of a subroutine which scans the individual register marks.

The scanning subroutine SCAN is shown in FIG. 11. It is assumed that scanning starts in the upper left-hand corner of the square closed path (126 in FIG. 4) about the center of the register mark 23, 24, and the scanning proceeds in a clockwise direction. Thus, to scan along the top of the square, the motor Mx is turned on forward in step 140. Then in step 150 a scan side subroutine SCSD is called which determines the actual coordinates of intersection between the top side of the square and the register crosses 35, 36, and 37.

The results of the subroutine call in step 150 are the three X coordinates of the points of intersection $A_x$, $B_x$ and $C_x$ which are stripped off a return parameter array CSTK in step 151. After the top side of the square is scanned, the motor Mx is turned off in step 152 and the motor My is turned on reverse in order to scan the right side of the square. In step 154, the scan side subroutine SCSD is called, and in step 155, the return parameter array CSTK is dumped to obtain the Y coordinates of the points of intersection $D_y$, $E_y$, and $F_y$. In step 155, the values from the parameter array CSTK are inverted since the motor My is moving in reverse, opposite to the incrementing of the position counter PC in step 106 of the interrupt subroutine of FIG. 8. In step 156, the motor My is turned off, and in step 157 the motor Mx is turned on reverse in order to scan the right-hand side of the square path. In step 158, the subroutine SCSD is called and the X coordinates of the points of intersection $G_x$, $H_x$ and $I_x$ are stripped off and inverted from the return parameter array CSTK in step 159.

Finally, to scan the left side of the square path, the motor Mx is turned off in step 160, the motor My is turned on forward in step 161, the subroutine SCSD is called in step 162, the Y coordinates of the points of intersection $J_y$, $K_y$, and $L_y$ are stripped off the return parameter array CSCK in step 163 and the motor My is turned off in step 164. To complete the subroutine SCAN, in step 165 the values for the deviation arrays DEVX, DEVY are calculated by averaging the deviations for the upper and lower points of intersection and the right and left points of intersection, respectively, and adding or subtracting the predetermined offset OFF depending upon whether the averages are negative or positive, respectively.

Figure 12:
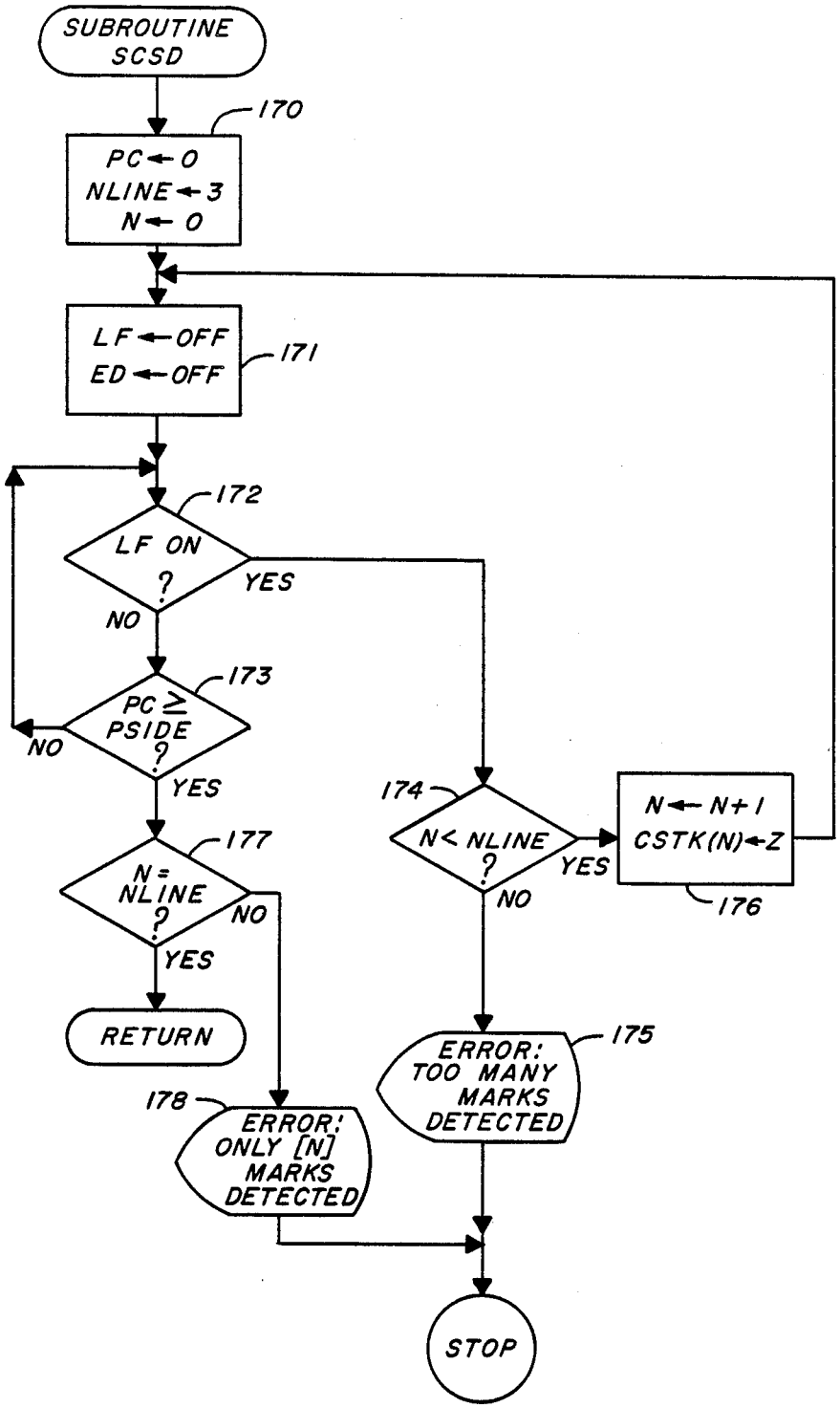
FIG. 12 is the flow chart of a subroutine which scans the individual register marks over 90° scanning intervals.

The subroutine SCSD which scans each side of the square path about each of the register marks 23, 24 is shown in FIG. 12. In step 170, the position counter PC is set to 0, the number of lines is set to three corresponding to the three crosses 35, 36 and 37 in the register marks 23, 24 (FIG. 2) and the line index N is set to zero. In step 171, the line flag LF and the edge detect flag ED are set off for use in the interrupt procedure of FIG. 8 for the purpose of detecting the presence of the register marks. The subroutine SCSD determines whether the interrupt routine of FIG. 8 has detected a line by checking in step 172 whether the line flag LF has been turned on. If not, in step 173 the position counter PC is compared to a predetermined length PSIDE corresponding to the number of stepper motor steps for one side of the square path 126. If not, which is the most frequent result during the scanning of one side of the square, execution returns to step 172 until the line flag is found to be on. In such a case, in step 174 the line index N is compared to the number of lines NLINE. If the index N is not less than in the number of lines NLINE, an error has occurred which is displayed to the printing machine operator in step 175. Otherwise, in step 176 the line index N is incremented and the position value Z having been calculated by the interrupt procedure of FIG. 8 is pushed into the return parameter array CSTK. Execution then returns to step 171 in order to reset the line flag LF and edge detect flag ED so that more lines may be detected. The normal termination of the scan side subroutine SCSD is through step 177 which as a final precaution compares the line index N to the number of lines. If they are not equal, then an error has occurred and an error message is displayed to the operator in step 178. Normally, execution returns from the subroutine SCSD, but if an error occurs, execution of the remote control computer 40 is terminated so that the operator will determine the cause of the error. After the cause of the error is determined and appropriate action is taken, the operator may restart the executive procedure of FIG. 10 at the beginning step 120 by activating the remote control computer's reset switch.

What is claimed is:

1. A method for automatically checking and correcting register adjustment of a multi-color sheet-fed printing press at a remote control desk of the type having an ink densitometer for optically sensing an ink density check strip printed traversely across a test sheet after the test sheet is placed on the remote control desk, the printing press having automatic means for adjusting axial and peripheral printing plate register, the automatic means for adjusting being controllable in response to remote control signals generated at the remote control desk, and wherein the ink densitometer is mounted to a computer controllable X,Y positioning mechanism, said method comprising the steps of:

printing at least one register mark on the test sheet using the sheet-fed printing press, manually transferring the printed sheet from the printing press to the remote control desk and orienting the test sheet so that the X,Y positioning mechanism may drive the ink densitometer to the general location of the register mark, automatically controlling the X,Y positioning mechanism to drive the ink densitometer to scan the register mark along a path generally surrounding the center of the register mark, automatically correlating the output signal of the ink densitometer with the actual coordinates of the X,Y positioning mechanism to determine the actual coordinates of the register mark, automatically calculating the deviations of the actual coordinates of the register mark from predetermined desired coordinates of the register mark, and using the deviations as register control values supplied to the automatic means for adjusting printing plate register.

2. The method as claimed in claim 1, wherein the deviations are displayed to a printing press operator and wherein the printing press operator uses the deviations to manually adjust remote controls at the remote control desk which supply the remote control signals to the automatic means for adjusting the printing plate register.

3. The method as claimed in claim 1, wherein register control values are automatically determined from the deviations and are automatically supplied to the automatic means for adjusting the printing plate register.

4. The method as claimed in claim 1, wherein at least one register mark is printed on the left-hand side of the sheet and at least one register mark is printed on the right-hand side of the test sheet, and wherein the ink densitometer scans a first register mark on one side of the sheet, quickly traverses to a second register mark on the opposite side of the sheet, and then scans the second register mark.

5. The method as claimed in claim 1, wherein the ink densitometer is driven along a circular path to scan the register mark, the register mark being in the form of a cross, so that if the ink densitometer is accurately scanned about the desired location of the register mark and if the register mark is properly positioned by correct register adjustment, the ink densitometer will emit electrical pulses indicating the points of intersection of the circular path with the register mark, the points of intersection indicating respective axial and peripheral register being offset by 90 degrees on the circular path.

6. The method as claimed in claim 1, wherein the register mark is comprised of at least two component marks of different colors printed by different printing plates in the printing press, and wherein the predetermined desired coordinates for one of the component marks is determined from the actual coordinates of a different component mark, the deviation thereby resulting in a relative register control value for adjusting the register of the corresponding printing plates with respect to each other.

* * * * *